US006891153B2

(12) United States Patent
Bateman et al.

(10) Patent No.: US 6,891,153 B2
(45) Date of Patent: May 10, 2005

(54) MASS SPECTROMETERS AND METHODS OF MASS SPECTROMETRY

(75) Inventors: Robert Harold Bateman, Knutsford (GB); Kevin Giles, Altrincham (GB)

(73) Assignee: Micromass UK Limited, Manchester (GB)

( * ) Notice: Subject to any disclaimer, the term of this patent is extended or adjusted under 35 U.S.C. 154(b) by 34 days.

(21) Appl. No.: 09/995,662

(22) Filed: Nov. 29, 2001

(65) Prior Publication Data

US 2002/0063209 A1 May 30, 2002

(30) Foreign Application Priority Data

| | | |
|---|---|---|
| Nov. 29, 2000 | (GB) | 0029088 |
| Apr. 20, 2001 | (GB) | 0109760 |
| Apr. 25, 2001 | (GB) | 0110149 |
| Aug. 16, 2001 | (GB) | 0120028 |

(51) Int. Cl.[7] ..... H01J 49/00

(52) U.S. Cl. ..... 250/281; 250/282; 250/288; 250/424; 250/423 P

(58) Field of Search ..... 250/281–300, 250/396 R, 423 R, 424

(56) References Cited

U.S. PATENT DOCUMENTS

| | | | | |
|---|---|---|---|---|
| 5,572,035 | A | | 11/1996 | Franzen |
| 5,818,055 | A | * | 10/1998 | Franzen ..... 250/292 |
| 6,107,628 | A | * | 8/2000 | Smith et al. ..... 250/292 |
| 2001/0035498 | A1 | | 11/2001 | Li et al. |

FOREIGN PATENT DOCUMENTS

| | | |
|---|---|---|
| CA | 2281405 | 3/2000 |
| GB | 2302985 | 2/1997 |
| GB | 2315364 | 1/1998 |
| GB | 2375653 | 11/2002 |
| JP | 11-307040 | 11/1999 |
| JP | 113852 | 4/2000 |
| JP | 123780 | 4/2000 |
| JP | 2002-15699 | 1/2002 |
| WO | WO97/49111 | 12/1997 |
| WO | 98/06481 | 2/1998 |
| WO | WO99/38185 | 7/1999 |

OTHER PUBLICATIONS

Teloy et al., "Integral Cross Sections for Ion–Molecule Reactions. 'I. The Guided Beam Technique'", Chemical Physics, pp. 417–427, (1974).

Gerlich et al., "Ion Trap Studies of Association Processes in Collisions of $Ch^{+3}$ and $CD^{+3}$ with $_n$–$H_2$, $_p$–$H_2$, $D_2$, and He at 80 K", The Astrophysical Journal, 347 pp. 849–854, 1989.

Gerlich, "Inhomogeneous RF Fields: A Versatile Tool for the Study of Processes with Slow Ions", Advances in Chemical Physics Series. vol. 1.XXXII., 1992.

Shaffer et al., "A Novel Ion Funnel for Focusing Ions at Elevated Pressures", The 45$^{th}$ ASMS Conference on Mass Spectrometry and Allied Topics, (1997).

Shaffer et al., "A Novel Ion Funnel for Focusing Ions at Elevated Pressure Using Electrospray Ionization Mass Spectrometry", Rapid. Communications in Mass Spectrometry, vol. 11, pp. 1813–1817 (1997).

Shaffer et al., "An Ion Funnel Interface for Improved Ion Focusing and Sensitivity Using Electrospray Ionization Mass Spectrometry", Analytical Chemistry, vol. 70, No. 19, pp. 4111–4119, (1998).

(Continued)

*Primary Examiner*—Nikita Wells
*Assistant Examiner*—Christopher M. Kalivoda
(74) *Attorney, Agent, or Firm*—Diederiks & Whitelaw, PLC

(57) ABSTRACT

An ion guide is disclosed comprising a plurality of electrodes each having apertures which are preferably circular and substantially the same size. The ion guide is preferably maintained in a vacuum chamber at a relatively high pressure.

65 Claims, 6 Drawing Sheets

OTHER PUBLICATIONS

Shaffer et al., "Characterization of an Improved Electrodynamic Ion Funnel Interface for Electrospray Ionization Mass Spectrometry", Analytical Chemistry, vol. 71, No. 15, pp. 2957–2964, (1999).

Tolmachev et al., "Charge Capacity Limitations of Radio Frequency Ion Guides in Their Use for Improved Ion Accumulation and Trapping in Mass Spectrometry", Analytical Chemistry, vol. 72, No. 5, pp. 970–978, (2000).

Bailey et al., "Design and Implementation of a New Electrodynamic Ion Funnel", Analytical Chemistry, vol. 72, No. 10, pp. 2247–2255, (2000).

Guan et al., "Stacked–Ring Electrostatic Ion Guide", American Society for Mass Spectrometry, vol. 7, No. 1, pp. 101–106, 1996.

Belov et al., "Initial Implementation of an Electrodynamic Ion Funnel With Fourier Transform Ion Cyclotron Resonance Mass Spectrometry", Journal of the American Society for Mass Spectrometry, vol. 11, No. 1, pp. 19–23, 2000.

* cited by examiner

MASS SPECTROMETERS AND METHODS OF MASS SPECTROMETRY

BACKGROUND OF THE INVENTION

1. Field of the Invention

The present invention relates to mass spectrometers and methods of mass spectrometry.

2. Discussion of the Prior Art

Ion guides comprising rf-only multipole rod sets such as quadrupoles, hexapoles and octopoles are well known.

An alternative type of ion guide known as an "ion funnel" has recently been proposed by Smith and co-workers at Pacific Northwest National Laboratory. An ion funnel comprises a stack of ring electrodes of constant external diameter but which have progressively smaller internal apertures. A dc voltage/potential gradient is applied along the length of the ion guide in order to urge ions through the ion funnel which would otherwise act as an ion mirror.

A variant of the standard ion funnel arrangement is disclosed in Anal. Chem. 2000, 72, 2247–2255 and comprises an initial drift section comprising ring electrodes having constant internal diameters and a funnel section comprising ring electrodes having uniformly decreasing internal diameters. A dc voltage gradient is applied across both sections in order to urge ions through the ion funnel.

Ion funnels have not been successfully employed in commercial mass spectrometers to date.

One reason for this may be that ion funnels suffer from a narrow bandpass transmission efficiency i.e. the ion funnel may, for example, only efficiently transmit ions having mass to charge ratios ("m/z") falling within a narrow range e.g. $100<m/z<200$. Reference is made, for example, to FIGS. 5A and 5B of Anal. Chem. 1998, 70, 4111–4119 wherein experimental results are presented comparing observed mass spectra obtained using an ion funnel with that obtained using a conventional ion guide. The experimental results show that both relatively low m/z and relatively high m/z ions fail to be transmitted by the ion funnel. Reference is also made to pages 2249 and 2250 of Anal. Chem 2000, 72, 2247–2255 which similarly recognises that ion funnels suffer from an undesirably narrow m/z transmission window.

Another reason may be that ion funnel ion guides require both an rf voltage and a dc voltage gradient to be applied to the ring electrodes. However, the design and manufacture of a reliable power supply capable of supplying both an rf voltage and a dc voltage gradient which is decoupled from the rf voltage is a non-trivial matter and increases the overall manufacturing cost of the mass spectrometer.

It is therefore desired to provide an improved ion guide.

SUMMARY OF THE INVENTION

The preferred embodiment comprises a plurality of electrodes wherein most if not all of the electrodes have apertures which are substantially the same size. The apertures are preferably circular in shape, and the outer circumference of the electrodes may also be circular. In one embodiment the electrodes may comprise ring or annular electrodes. However, the outer circumference of the electrodes does not need to be circular and embodiments of the present invention are contemplated wherein the outer profile of the electrodes may take on other shapes. The preferred embodiment wherein the internal apertures of each of the electrodes are either identical or substantially similar is referred to hereinafter as an "ion tunnel" in contrast to ion funnels which have ring electrodes with internal apertures which become progressively smaller in size.

One advantage of the preferred embodiment is that the ion guide does not suffer from a narrow or limited mass to charge ratio transmission efficiency which appears to be inherent with ion funnel arrangements.

Another advantage of the preferred embodiment is that a dc voltage gradient is not and does not need to be applied to the ion guide. The resulting power supply for the ion guide can therefore be significantly simplified compared with that required for an ion funnel thereby saving costs and increasing reliability.

An additional advantage of the preferred embodiment is that it has been found to exhibit an approximately 75% improvement in ion transmission efficiency compared with a conventional multipole, e.g. hexapole, ion guide. The reasons for this enhanced ion transmission efficiency are not fully understood, but it is thought that the ion tunnel may have a greater acceptance angle and a greater acceptance area than a comparable multipole rod set ion guide.

The preferred ion guide therefore represents a significant improvement over other known ion guides.

Various types of ion optical devices other than an ion tunnel ion guide are known including multipole rod sets, Einzel lenses, segmented multipoles, short (solid) quadrupole pre/post filter lenses ("stubbies"), 3D quadrupole ion traps comprising a central doughnut shaped electrode together with two concave end cap electrodes, and linear (2D) quadrupole ion traps comprising a multipole rod set with entrance and exit ring electrodes. However, such devices are not intended to fall within the scope of the present invention.

According to the preferred embodiment, the input vacuum chamber is arranged to be maintained at a relatively high pressure i.e. at least a fewmbar. According to an embodiment, the input vacuum chamber may be arranged to be maintained at a pressure above a minimum value and less than or equal to a maximum value such as 20 or 30 mbar.

Embodiments of the present invention are also contemplated, wherein if the AC ion guide is considered to have a length L and is maintained in the input vacuum chamber at a pressure P, then the pressure-length product $p \times L$ is selected from the group comprising: (i) $\geqq 1$ mbar cm; (ii) $\geqq 2$ mbar cm; (iii) $\geqq 5$ mbar cm; (iv) $\geqq 10$ mbar cm; (v) $\geqq 15$ mbar cm; (vi) $\geqq 20$ mbar cm; (vii) $\geqq 25$ mbar cm; (viii) $\geqq 30$ mbar cm; (ix) $\geqq 40$ mbar cm; (x) $\geqq 50$ mbar cm; (xi) $\geqq 60$ mbar cm; (xii) $\geqq 70$ mbar cm; (xiii) $\geqq 80$ mbar cm; (xiv) $\geqq 90$ mbar cm; (xv) $\geqq 100$ mbar cm; (xvi) $\geqq 110$ mbar cm; (xvii) $\geqq 120$ mbar cm; (xviii) $\geqq 130$ mbar cm; (xix) $\geqq 140$ mbar cm; (xx) $\geqq 150$ mbar cm; (xxi) $\geqq 160$ mbar cm; (xxii) $\geqq 170$ mbar cm; (xxiii) $\geqq 180$ mbar cm; (xxiv) $>190$ mbar cm; and (xxv) $\geqq 200$ mbar cm.

The electrodes are preferably relatively thin e.g. $\leqq 2$ mm, further preferably $\leqq 1$ mm, further preferably $0.5 \pm 0.2$ mm, further preferably $0.7 \pm 0.1$ mm thick. According to a particularly preferred embodiment the electrodes have a thickness within the range 0.5–0.7 mm in contrast to multipole rod sets which are typically >10 cm long.

Each, or at least a majority of the electrodes forming the AC ion guide may comprise either a plate having an aperture therein, or a wire or rod bent to form a closed ring or a nearly closed ring. The outer profile of the electrodes may or may not be circular.

Preferably, alternate electrodes are connected together and to one of the output connections of a single AC generator.

The AC ion guide preferably comprises at least 4, 5, 6, 7, 8, 9, 10, 20, 30, 40, 50, 60, 70, 80, 90 or 100 electrodes.

The electrodes forming the AC ion guide may have internal diameters or dimensions selected from the group comprising: (i) ≦5.0 mm; (ii) ≦4.5 mm; (iii) ≦4.0 mm; (iv) ≦3.5 mm; (v) ≦3.0 mm; (vi) ≦2.5 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

The length of the AC ion guide may be selected from the group comprising: (i) ≧100 mm; (ii) ≧120 mm; (iii) ≧150 mm; (iv) 130±10 mm; (v) 100–150 mm; (vi) ≦160 mm; (vii) ≦180 mm; (viii) ≦200 mm; (ix) 130–150 mm; (x) 120–180 mm; (xi) 120–140 mm; (xii) 130 mm±5, 10, 15, 20, 25 or 30 mm; (xiii) 50–300 mm; (xiv) 150–300 mm; (xv) ≧50 mm; (xvi) 50–100 mm; (xvii) 60–90 mm; (xviii) ≧75 mm; (xix) 50–75 mm; and (xx) 75–100 mm.

Preferably, an intermediate vacuum chamber may be disposed between the input vacuum chamber and the analyzer vacuum chamber, the intermediate vacuum chamber comprising an AC ion guide for transmitting ions through the intermediate vacuum chamber, the AC ion guide arranged in the intermediate vacuum chamber comprising a plurality of electrodes having apertures, the apertures being aligned so that ions travel through them as they are transmitted by the ion guide. At least one further differential pumping apertured electrode is provided through which ions may pass. The further differential pumping apertured electrode is disposed between the vacuum chambers to allow the intermediate vacuum chamber to be maintained at a lower pressure than the input vacuum chamber, and the analyzer vacuum chamber to be maintained at a lower pressure than the intermediate vacuum chamber. An alternating current (AC) generator is connected to an intermediate chamber reference potential for providing AC potentials to the AC ion guide in the intermediate vacuum chamber.

Preferably, at least 90%, and preferably 100%, of the apertures of the electrodes forming the AC ion guide in said intermediate vacuum chamber are substantially the same size, and at least 90%, and preferably 100%, of the plurality of the electrodes forming the AC ion guide in the intermediate vacuum chamber are connected to the AC generator connected to the intermediate chamber reference potential in such a way that at any instant during an AC cycle of the output of the AC generator, adjacent ones of the electrodes forming the AC ion guide arranged in the intermediate vacuum chamber are supplied respectively with approximately equal positive and negative potentials relative to the intermediate chamber reference potential.

Preferably, the AC ion guide in the intermediate vacuum chamber comprises at least 4, 5, 6, 7, 8, 9, 10, 20, 30, 40, 50, 60, 70, 80, 90, or 100 electrodes.

Preferably, the intermediate vacuum chamber is arranged to be maintained at a pressure selected from the group comprising: (i) $10^{-3}$–$10^{-2}$ mbar; (ii) ≧$2\times10^{-3}$ mbar; (iii) ≧$5\times10^{-3}$ mbar; (iv) ≦$10^{-2}$ mbar; (v) $10^{-3-5\times10-3}$ mbar; and (vi) $5\times10^{-3}$–$10^{-2}$ mbar.

Preferably, the electrodes forming the AC ion guide in the intermediate vacuum chamber have internal diameters or dimensions selected from the group comprising: (i) ≦5.0 mm; (ii) ≦4.5 mm; (iii) ≦4.0 mm; (iv) ≦3.5 mm; (v) ≦3.0 mm; (vi) ≦2.5 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

In one embodiment the individual electrodes in the AC ion guide in the input vacuum chamber and/or the AC ion guide in the intermediate vacuum chamber preferably have a substantially circular aperture having a diameter selected from the group comprising: (i) 0.5–1.5 mm; (ii) 1.5–2.5 mm; (iii) 2.5–3.5 mm; (iv) 3.5–4.5 mm; (v) 4.5–5.5 mm; (vi) 5.5–6.5 mm; (vii) 6.5–7.5 mm; (viii) 7.5–8.5 mm; (ix) 8.5–9.5 mm; (x) 9.5–10.5 mm; and (xi) <10 mm.

Preferably, the length of the ion guide in the intermediate vacuum chamber is selected from the group comprising: (i) ≧100 mm; (ii) ≧120 mm; (iii) ≧150 mm; (iv) 130±10 mm; (v) 100–150 mm; (vi) ≦160 mm; (vii) ≦180 mm; (viii) ≦200 mm; (ix) 130–150 mm; (x) 120–180 mm; (xi) 120–140 mm; (xii) 130 mm±5, 10, 15, 20, 25 or 30 mm; (xiii) 50–300 mm; (xiv) 150–300 mm; (xv) 250 mm; (xvi) 50–100 mm; (xvii) 60–90 mm; (xviii) ≧75 mm; (xix) 50–75 mm; and (xx) 75–100 mm.

Preferably, the ion source is an atmospheric pressure ion source.

Preferably, the ion source is a continuous ion source.

An Electrospray ("ES") ion source or an Atmospheric Pressure Chemical Ionisation ("APCI") ion source is particularly preferred. However, other embodiments are also contemplated wherein the ion source is either an Inductively Coupled Plasma ("ICP") ion source or a Matrix Assisted Laser Desorption Ionisation ("MALDI") ion source at low vacuum or at atmospheric pressure.

Preferably, the ion mass analyser is selected from the group comprising: (i) a time-of-flight mass analyser, preferably an orthogonal time of flight mass analyser; (ii) a quadrupole mass analyser; and (iii) a quadrupole ion trap.

Preferably, the AC ion guide comprises two interleaved comb arrangements, each comb arrangement comprising a plurality of electrodes having apertures.

Preferably, the AC ion guide comprises at least one comb arrangement comprising a longitudinally extending member having a plurality of electrodes having apertures depending therefrom.

Preferably, the input vacuum chamber has a length and the comb arrangement extends at least x% of the length, x% selected from the group comprising: (i) ≧50%; (ii) ≧60%; (iii) ≧70%; (iv) ≧80%; (v) ≧90%; and (vi) ≧95%.

BRIEF DESCRIPTION OF THE DRAWINGS

Various embodiments of the present invention will now be described, by way of example only, and with reference to the accompanying drawings in which.

DETAILED DESCRIPTION OF THE INVENTION

Figure 1:
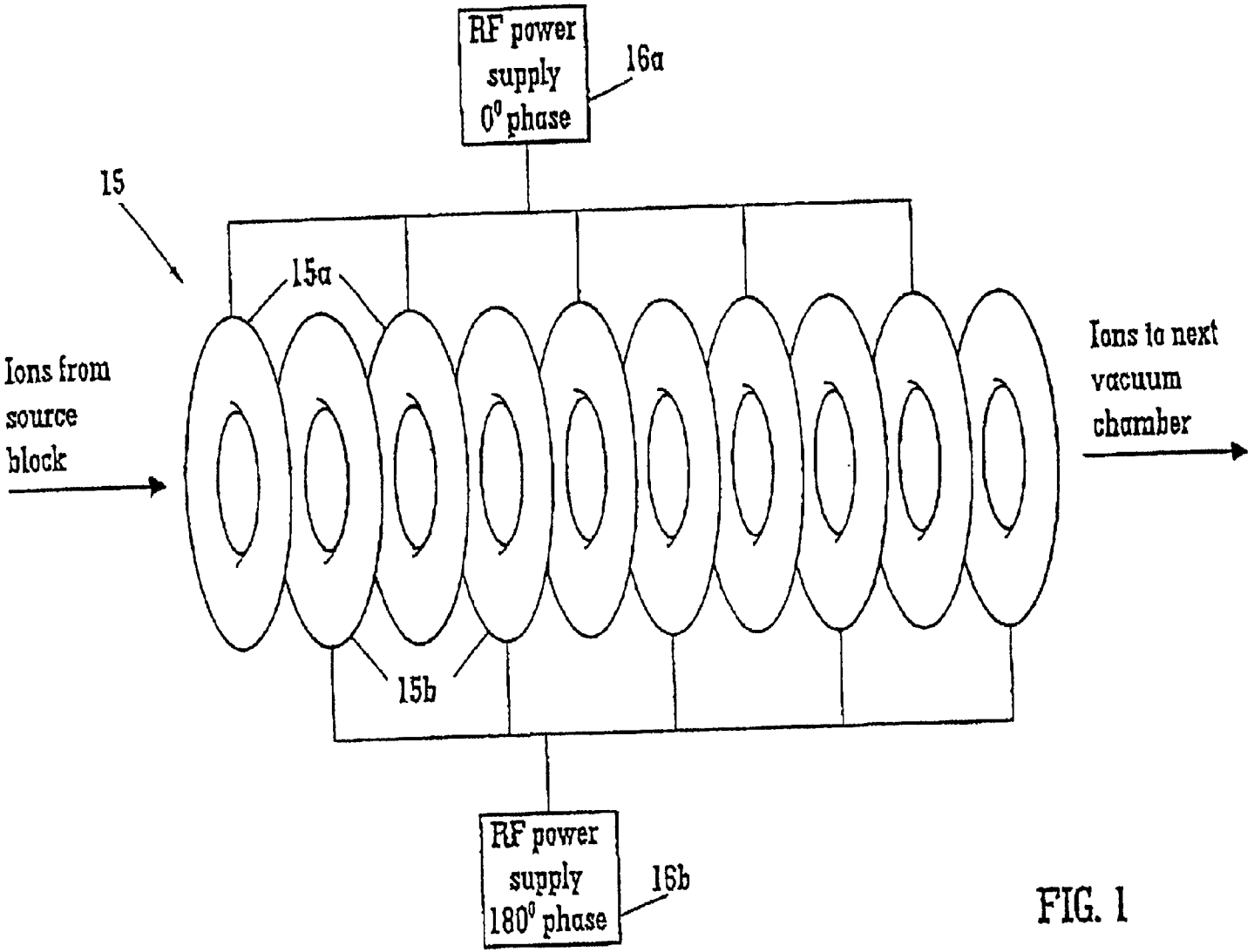
FIG. 1 shows a preferred ion tunnel arrangement.

As shown in FIG. 1, a preferred ion tunnel 15 comprises a plurality of electrodes 15*a*, 15*b* each having an aperture. In the embodiment shown, the outer profile of the electrodes 15*a*, 15*b* is circular. However, the outer profile of the electrodes 15*a*, 15*b* does not need to be circular. Although the preferred embodiment may be considered to comprise a plurality of ring or annular electrodes, electrodes having other shapes are also contemplated as falling within the scope of the present invention.

Adjacent electrodes 15*a*, 15*b* are connected to different phases of an AC power supply. For example, the first, third, fifth etc. ring electrodes 15*a* may be connected to the 0° phase supply 16*a*, and the second, fourth, sixth etc. ring electrodes 15*b* may be connected to the 180° phase supply 16*b*. In one embodiment the AC power supply may be a RF power supply. However, the present invention is not intended to be limited to RF frequencies. Furthermore, "AC" is intended to mean simply that the waveform alternates and hence embodiments of the present invention are also contemplated wherein non-sinusoidal waveforms including square waves are provided. Ions from an ion source pass through the ion tunnel 15 and are efficiently transmitted by it.

In contrast to ion funnels, the dc reference potential about which the AC signal oscillates is substantially the same for each electrode. Unlike ion traps, blocking dc potentials are not applied to either the entrance or exit of the ion tunnel 15.

Figure 2:
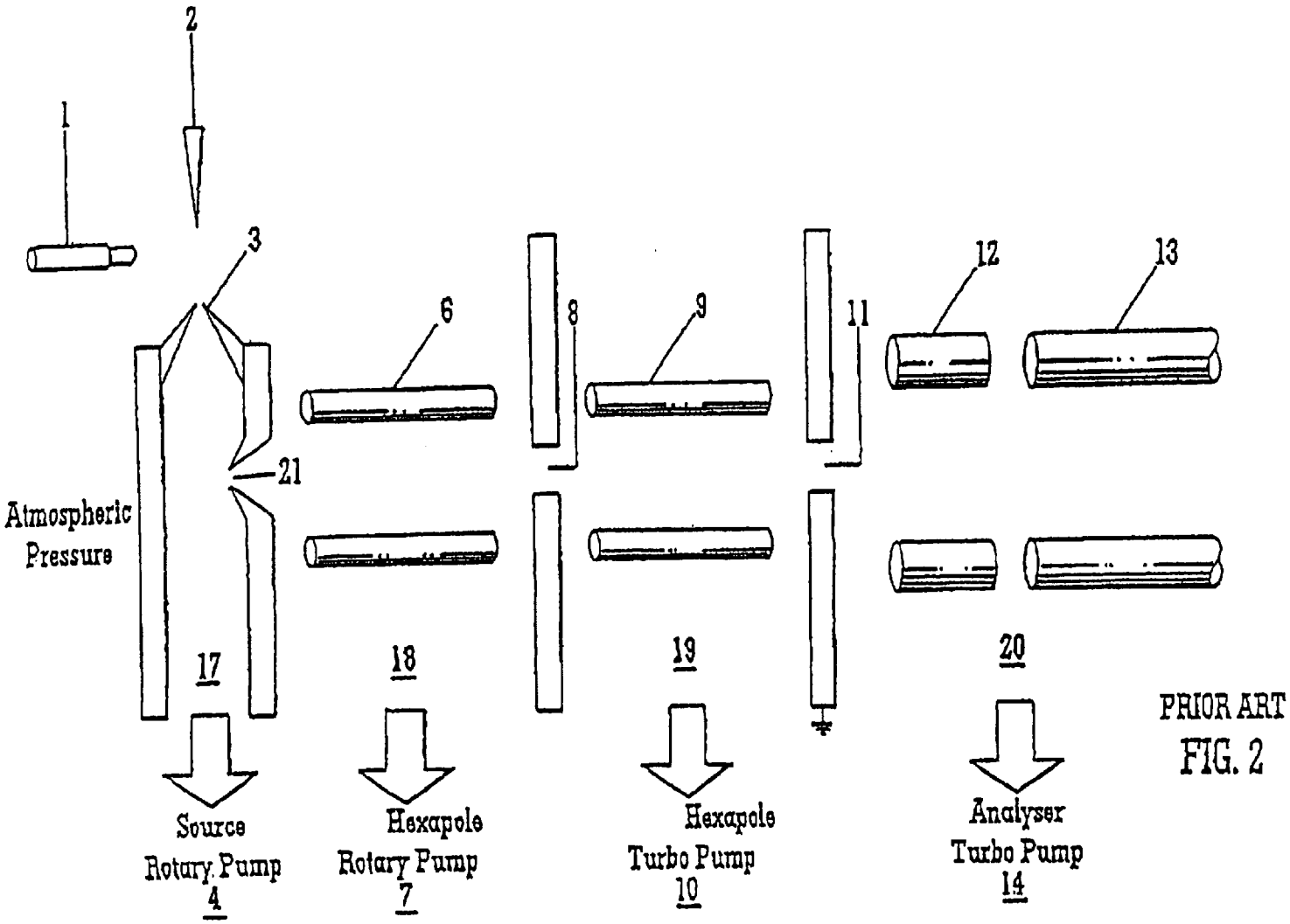
PRIOR ART FIG. 2
FIG. 2 shows a conventional mass spectrometer with an atmospheric pressure ion source and two rf hexapole ion guides disposed in separate vacuum chambers.

FIG. 2 shows a conventional mass spectrometer. An Electrospray ("ES") ion source 1 or an Atmospheric Pressure Chemical Ionisation ("APCI") 1,2 ion source emits ions which enter a vacuum chamber 17 pumped by a rotary or mechanical pump 4 via a sample cone 3 and a portion of the gas and ions passes through a differential pumping aperture 21 preferably maintained at 50–120V into a vacuum chamber 18 housing an rf-only hexapole ion guide 6. Vacuum chamber 18 is pumped by a rotary or mechanical pump 7. Ions are transmitted by the rf-only hexapole ion guide 6 through the vacuum chamber 18 and pass through a differential pumping aperture 8 into a further vacuum chamber 19 pumped by a turbo-molecular pump 10. This vacuum chamber 19 houses another rf-only hexapole ion guide 9. Ions are transmitted by rf-only hexapole ion guide 9 through vacuum chamber 19 and pass through differential pumping aperture 11 into a yet further vacuum chamber 20 which is pumped by a turbo-molecular pump 14. Vacuum chamber 20 houses a prefilter rod set 12, a quadrupole mass filter/analyser 13 and may include other elements such as a collision cell (not shown), a further quadrupole mass filter/analyser together with an ion detector (not shown) or a time of flight analyser (not shown).

Figure 3:
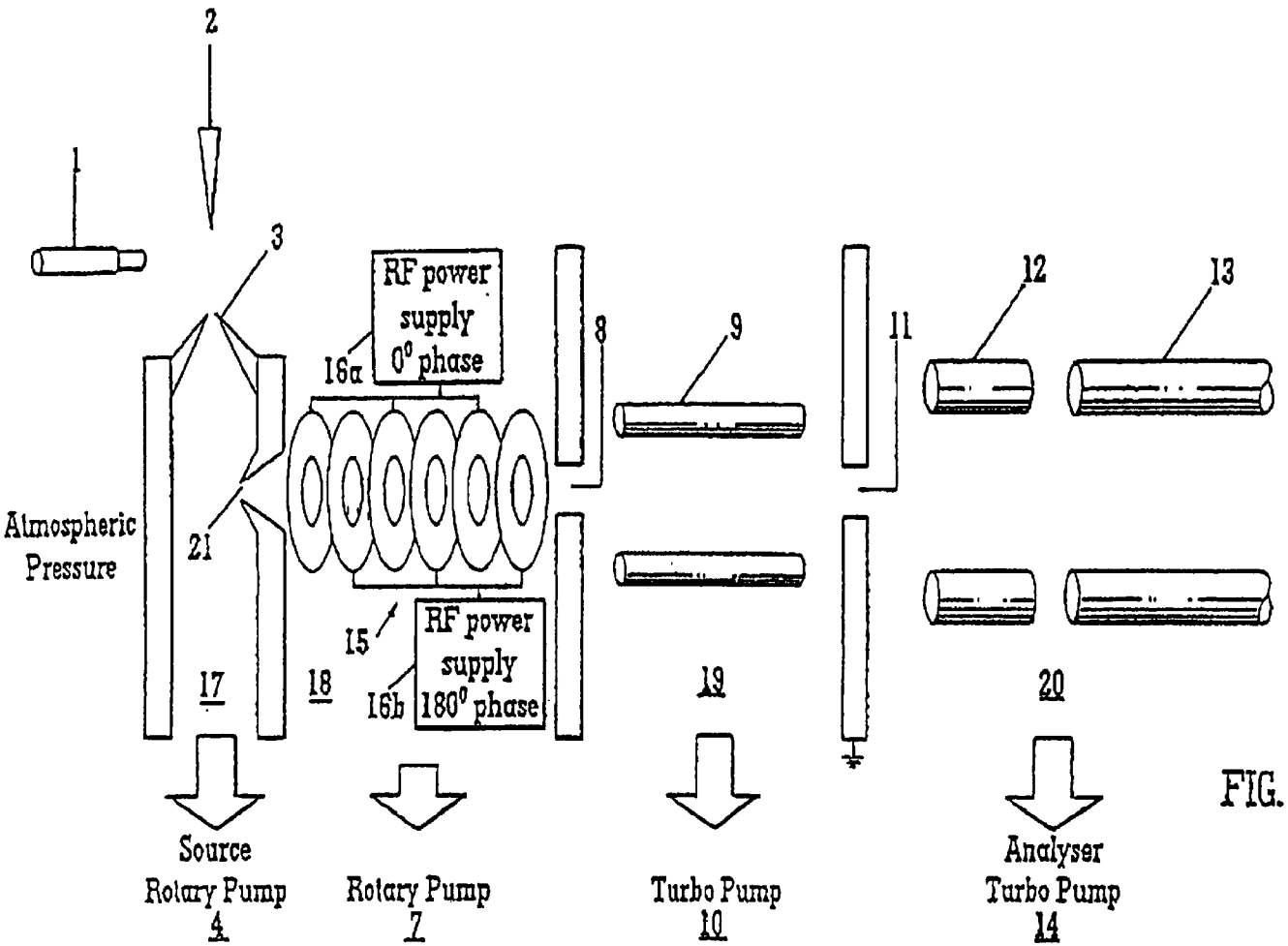
FIG. 3 shows an embodiment of the present invention wherein one of the hexapole ion guides has been replaced with an ion tunnel.

FIG. 3 illustrates an embodiment of the present invention wherein hexapole ion guide 6 has been replaced with an ion tunnel 15 according to the preferred embodiment. The other components of the mass spectrometer are substantially the same as described in relation to FIG. 2 and hence will not be described again. The ion tunnel 15 exhibits an improved transmission efficiency of approximately 75% compared with using hexapole ion guide 6 and the ion tunnel 15 does not suffer from as narrow a m/z bandpass transmission efficiency as is reported with ion funnels. An rf-voltage is applied to the electrodes and the reference potential of the ion tunnel 15 is preferably maintained at 0–2 V dc above the dc potential of the wall forming the differential pumping aperture 11 which is preferably either at ground (0 V dc) or around 40–240 V dc depending upon the mass analyser used. However, the wall forming differential pumping aperture 11 may, of course, be maintained at other dc potentials.

In another less preferred (unillustrated) embodiment, the hexapole ion guide 9 may be replaced by an ion tunnel 15' with hexapole ion guide 6 being maintained.

Figure 4:
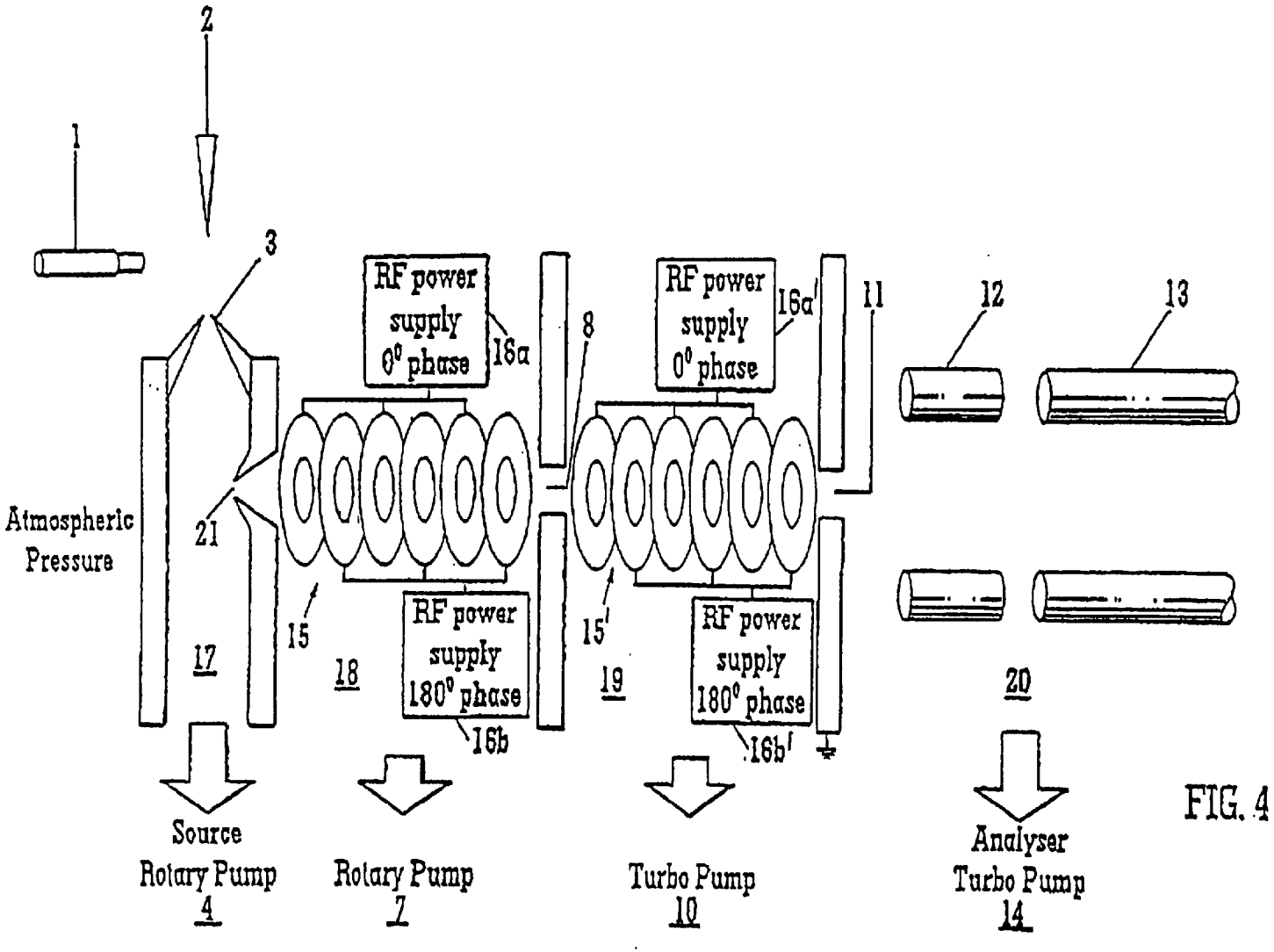
FIG. 4 shows another embodiment of the present invention wherein both hexapole ion guides have been replaced with ion tunnels.

FIG. 4 shows a particularly preferred embodiment of the present invention wherein both hexapole ion guides 6,9 have been replaced with ion tunnels 15,15'. The ion tunnels 15,15' are about 13 cm in length and preferably comprise approximately 85 ring electrodes. The ion tunnel 15 in vacuum chamber 18 is preferably maintained at a pressure $\geqq 1$ mbar and is supplied with an rf-voltage at a frequency ~1 MHz, and the ion tunnel 15' in vacuum chamber 19 is preferably maintained at a pressure of $10^{-3}$–$10^{-2}$ mbar and is supplied with an rf-voltage at a frequency ~2 MHz. Rf frequencies of 800 kHz-3 MHz could also be used for both ion tunnels 15,15' according to further embodiments of the present invention.

The ion tunnel 15' exhibits an improved transmission efficiency of approximately 25%, and hence the combination of ion tunnels 15,15' exhibit an improved transmission efficiency of approximately 100% compared with using hexapole ion guide 6 in combination with hexapole ion guide 9.

Figure 5:
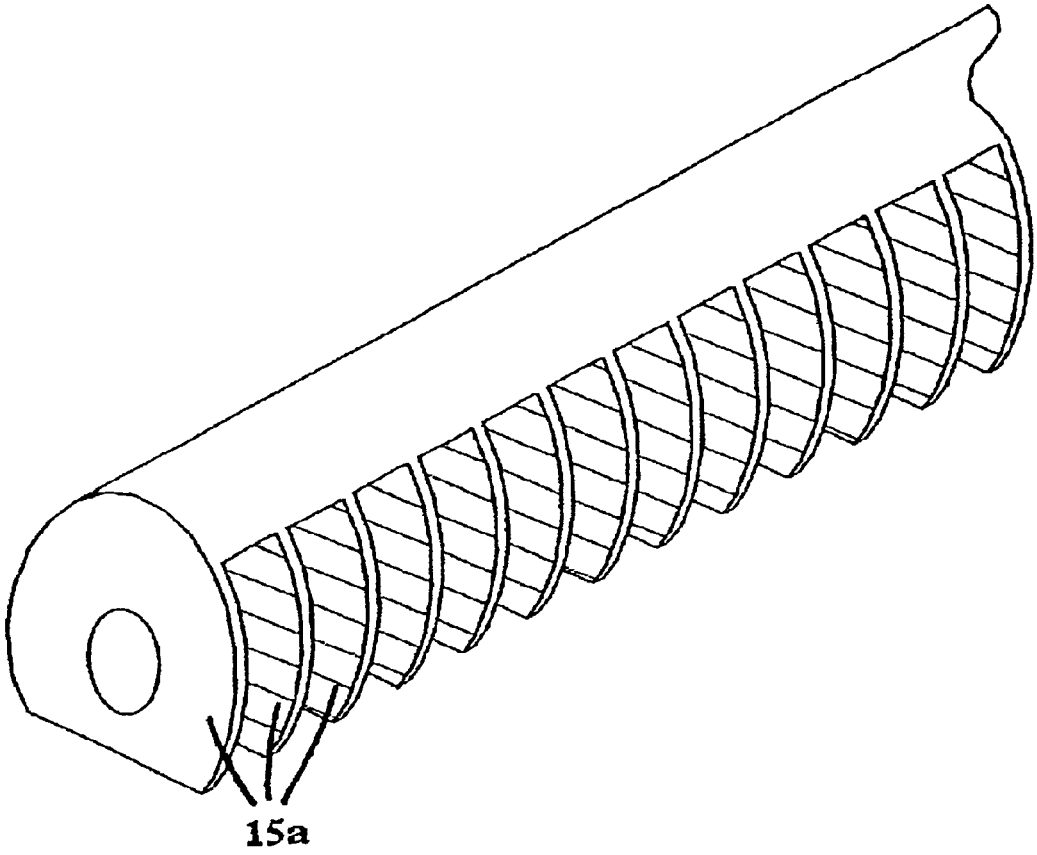
FIG. 5 shows a comb arrangement.
Figure 6:
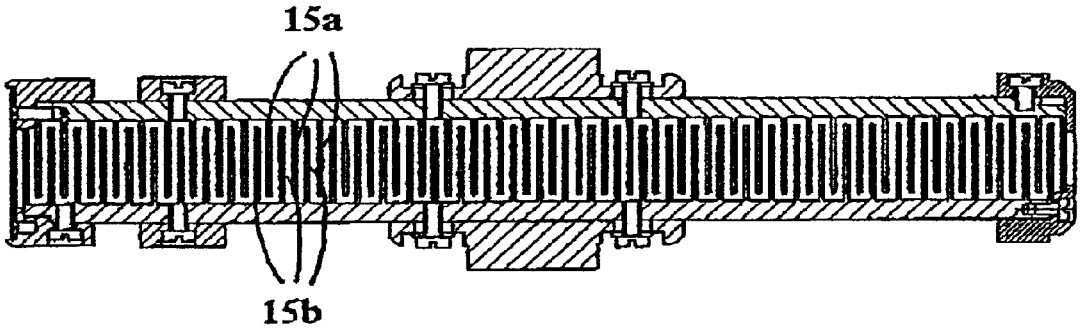
FIG. 6 shows a particularly preferred embodiment comprising two interleaved comb-like arrangements.

FIGS. 5 and 6 show a particularly preferred embodiment of the present invention. The AC ion guide comprises two interleaved comb-like arrangements of electrodes. Each comb comprises a plurality of electrodes 15*a*; 15*b*, each electrode 15*a*; 15*b* having an aperture. One of the combs is shown in more detail in FIG. 5. As can be seen, the comb comprises a longitudinally extending bar or spine from which a number of electrodes 15*a*;15*b* depend therefrom. The electrodes 15*a*; 15*b* may either be integral with the bar or spine, or alternatively they may be electrically connected to the bar or spine. Each electrode 15*a*;15*b* preferably has a substantially circular aperture. However, as can be seen from FIG. 5, in cross-section the outer profile of each electrode 15*a*; 15*b* is preferably a truncated circular shape. FIG. 6 shows in more detail how the two combs are interleaved. Various insulating rings are also shown which help to hold the assembly together. The comb like arrangement of electrodes 15*a*;15*b* may be provided in input vacuum chamber 18 and/or intermediate vacuum chamber 19. For the avoidance of any doubt, the arrangements shown in FIGS. 5 and 6 are intended to fall within the scope of the claims. A further embodiment is also contemplated comprising three interleaved combs connected to a 3-phase AC generator.

Although described with reference to preferred embodiments of the invention, it should be understood that various changes and/or modifications can be made without departing from the spirit thereof. In general, the invention is only intended to be limited by the scope of the following claims.

We claim:

1. A mass spectrometer comprising:

an ion source for producing ions;

an input vacuum chamber comprising at least one AC ion guide for transmitting said ions, said AC ion guide comprising a plurality of electrodes having apertures, said apertures being aligned so that ions travel through them as they are transmitted by said ion guide;

an analyzer vacuum chamber comprising an ion mass analyzer disposed to receive ions after they have been transmitted by said ion guide;

at least one differential pumping apertured electrode though which ions may pass, said at least one differential pumping apertured electrode being disposed between said input vacuum chamber and said analyzer vacuum chamber to permit said analyzer vacuum chamber to be maintained at a lower pressure than said input vacuum chamber;

at least one alternating current (AC) generator connected to an input chamber reference potential for providing AC potentials to said plurality of electrodes;

wherein:

at least 90% of said apertures are substantially the same size;

at least 90% of said plurality of electrodes forming said AC ion guide are connected to said AC generator in such a way that at any instant during an AC cycle of the output of said AC generator, adjacent ones of said electrodes are supplied respectively with approximately equal positive and negative potentials relative to said input chamber reference potential; and wherein said input vacuum chamber is arranged to be maintained at a pressure selected from the group consisting of: (i) ≧0.1 mbar; (ii) ≧0.5 mbar; (iii) ≧0.7 mbar; (iv) ≧1.0 mbar; (v) ≧1.3 mbar; (vi) ≧1.5 mbar; (vii) ≧2.0 mbar; (viii) ≧2.5 mbar; (ix) ≧3.0 mbar; (x) ≧3.5 mbar; (xi) ≧4.0 mbar; (xii) ≧4.5 mbar; (xiii) ≧5.0 mbar; (xiv) ≧6.0 mbar; (xv) ≧7.0 mbar; (xvi) ≧8.0 mbar; (xvii) ≧9.0 mbar; (xviii) ≧10.0 mbar; (xix) 1–5 mbar; (xx) 1–2 mbar; (xxi) 0.5–1.5 mbar.

2. A mass spectrometer as claimed in claim 1, wherein said electrodes comprise a plate having an aperture therein.

3. A mass spectrometer as claimed in claim 1, wherein said electrodes comprise a wire or rod bent to form a substantially closed ring.

4. A mass spectrometer as claimed in claim 1, wherein alternate ones of said electrodes are connected to each other and to one of the output connections of a single AC generator.

5. A mass spectrometer as claimed in claim 1, wherein the AC ion guide comprises at least 4, 5, 6, 7, 8, 9, 10, 20, 30, 40, 50, 60, 70, 80, 90, or 100 electrodes.

6. A mass spectrometer as claimed in claim 1, wherein said electrodes have internal diameters or dimensions selected from the group consisting of: (i) ≦5.0 mm; (ii) ≦4.5 mm; (iii) ≦4.0 mm; (iv) ≦3.5 mm; (v) ≦3.0 mm; (vi) ≦2.5 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

7. A mass spectrometer as claimed in claim 1, wherein the length of said AC ion guide is selected from the group consisting of: (i) ≧100 mm; (ii) ≧120 mm; (iii) ≧150 mm; (iv) 130±10 mm; (v) 100–150 mm; (vi) ≦160 mm; (vii) ≦180 mm; (viii) ≦200 mm; (ix) 130–150 mm; (x) 120–180 mm; (xi) 120–140 mm; (xii) 130 mm±5, 10, 15, 20, 25 or 30 mm; (xiii) 50–300 mm; (xiv) 150–300 mm; (xv) ≧50 mm; (xvi) 50–100 mm; (xvii) 60–90 mm; (xviii) ≧75 mm; (xix) 50–75 mm; (xx) 75–100 mm; (xxi) 150–200 mm; (xxii) ≧200 mm; and (xxiii) 50–200 mm.

8. A mass spectrometer as claimed in claim 1, further comprising:

an intermediate vacuum chamber disposed between said input vacuum chamber and said analyzer vacuum chamber, said intermediate vacuum chamber comprising an AC ion guide for transmitting ions through said intermediate vacuum chamber, said AC ion guide arranged in said intermediate vacuum chamber comprising a plurality of electrodes having apertures, the apertures being aligned so that ions travel through them as they are transmitted by said ion guide;

at least one further differential pumping apertured electrode through which ions may pass, disposed between said vacuum chambers to allow said intermediate vacuum chamber to be maintained at a lower pressure than said input vacuum chamber, and said analyzer vacuum chamber to be maintained at a lower pressure than said intermediate vacuum chamber; and an alternating current (AC) generator connected to an intermediate chamber reference potential for providing AC potentials to the AC ion guide in said intermediate vacuum chamber.

9. A mass spectrometer as claimed in claim 8, wherein:

at least 90% of the apertures of the electrodes forming said AC ion guide in said intermediate vacuum chamber are substantially the same size; and at least 90% of said plurality of the electrodes forming said AC ion guide in said intermediate vacuum chamber are connected to the AC generator connected to said intermediate chamber reference potential in such a way that at any instant during an AC cycle of the output of the AC generator, adjacent ones of said electrodes forming said AC ion guide arranged in said intermediate vacuum chamber are supplied respectively with approximately equal positive and negative potentials relative to said intermediate chamber reference potential.

10. A mass spectrometer as claimed in claim 8, wherein the AC ion guide in said intermediate vacuum chamber comprises at least 4, 5, 6, 7, 8, 9, 10, 20, 30, 40, 50, 60, 70, 80, 90, or 100 electrodes.

11. A mass spectrometer as claimed in claim 8, wherein said intermediate vacuum chamber is arranged to be maintained at a pressure selected from the group consisting of: (i) $10^{-3}$–$10^{-2}$ mbar; (ii) ≧$2\times10^{-3}$ mbar; (iii) ≧$5\times10^{-3}$ mbar; (iv) ≦$10^{-2}$ mbar; (v) $10^{-3-5\times10-3}$ mbar; and (vi) $5\times10^{-3}$–$10^{-2}$ mbar.

12. A mass spectrometer as claimed in claim 8, wherein electrodes forming said AC ion guide in said intermediate vacuum chamber have internal diameters or dimensions selected from the group consisting of: (i) ≦5.0 mm; (ii) ≦4.5 mm; (iii) ≦4.0 mm; (iv) ≦3.5 mm; (v) ≦3.0 mm; (vi) ≦2.5 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

13. A mass spectrometer as claimed in claim 8, wherein the length of said ion guide in said intermediate vacuum chamber is selected from the group consisting of: (i) ≧100 mm; (ii) ≧120 mm; (iii) ≧150 mm; (iv) 130±10 mm; (v) 100–150 mm; (vi) ≦160 mm; (vii) ≦180 mm; (viii) ≦200 mm; (ix) 130–150 mm; (x) 120–180 mm; (xi) 120–140 mm; (xii) 130 mm±5, 10, 15, 20, 25 or 30 mm; (xiii) 50–300 mm; (xiv) 150–300 mm; (xv) ≧50 mm; (xvi) 50–100 mm; (xvii) 60–90 mm; (xviii) ≧75 mm; (xix) 50–75 mm; (xx) 75–100 mm; (xxi) 150–200 mm; (xxii) ≧200 mm; and (xxiii) 50–200 mm.

14. A mass spectrometer as claimed in claim 1, wherein said ion source is an atmospheric pressure ion source.

15. A mass spectrometer as claimed in claim 1, wherein said ion source is a continuous ion source.

16. A mass spectrometer as claimed in claim 1, wherein said ion source is an Electrospray ("ES") ion source or an Atmospheric Pressure Chemical Ionisation ("APCI") ion source.

17. A mass spectrometer as claimed in claim 1, wherein said ion source is an Inductively Coupled Plasma ("ICP") ion source.

18. A mass spectrometer as claimed in claim 1, wherein said ion source is a Matrix Assisted Laser Desorption Ionisation ("MALDI") ion source.

19. A mass spectrometer as claimed in claim 1, wherein said ion mass analyser is selected from the group consisting of: (i) a time-of-flight mass analyser, (ii) an orthogonal time of flight mass analyser; (iii) a quadrupole mass analyser; and (iv) a quadrupole ion trap.

20. A mass spectrometer as claimed in claim 1, wherein said input vacuum chamber is arranged to be maintained at a pressure selected from the group consisting of (i) ≦20 mbar; and (ii) ≦30 mbar.

21. A mass spectrometer as claimed in claim 1, wherein the AC ion guide comprises at least one comb arrangement comprising a longitudinally extending member having a plurality of electrodes having apertures depending therefrom.

22. A mass spectrometer as claimed in claim 21, wherein said input vacuum chamber has a length and said comb arrangement extends at least x% of said length, x% selected from the group consisting of: (i) ≧50%; (ii) ≧60%; (iii) ≧70%; (iv) ≧80%; (v) ≧90%; and (vi) ≧95%.

23. A mass spectrometer comprising:

an ion source for producing ions;

an input vacuum chamber comprising at least one AC ion guide for transmitting said ions, said AC ion guide comprising a plurality of electrodes having apertures, said apertures being aligned so that ions travel through them as they are transmitted by said ion guide;

an analyzer vacuum chamber comprising an ion mass analyzer disposed to receive ions after they have been transmitted by said ion guide;

at least one differential pumping apertured electrode though which ions may pass, said at least one differential pumping apertured electrode being disposed between said input vacuum chamber and said analyzer vacuum chamber to permit said analyzer vacuum chamber to be maintained at a lower pressure than said input vacuum chamber;

wherein:

at least 90% of said apertures are substantially the same size;

at least 90% of said plurality of electrodes forming said AC ion guide are connected to an AC generator; and wherein said input vacuum chamber is arranged to be maintained at a pressure selected from the group consisting of: (i) ≧0.1 mbar; (ii) ≧0.5 mbar; (iii) ≧0.7 mbar; (iv) ≧1.0 mbar; (v) ≧1.3 mbar; (vi) ≧1.5 mbar; (vii) ≧2.0 mbar; (viii) ≧2.5 mbar; (ix) ≧3.0 mbar; (x) ≧3.5 mbar; (xi) ≧4.0 mbar; (xii) ≧4.5 mbar; (xiii) ≧5.0 mbar; (xiv) ≧6.0 mbar; (xv) ≧7.0 mbar; (xvi) ≧8.0 mbar; (xvii) ≧9.0 mbar; (xviii) ≧10.0 mbar; (xix) 1–5 mbar; (xx) 1–2 mbar; (xxi) 0.5–1.5 mbar.

24. A mass spectrometer as claimed in claim 1, wherein the electrodes forming the AC ion guide have a thickness selected from the group consisting of: (i) ≦2 mm; (ii) ≦1 mm; (iii) 0.5±0.2 mm; (iv) 0.7±0.1 mm; and (v) 0.5–0.7 mm.

25. A mass spectrometer as claimed in claim 23, wherein said input vacuum chamber is arranged to be maintained at a pressure selected from the group consisting of: (i) ≦20 mbar; and (ii) ≦30 mbar.

26. A method of mass spectrometry, comprising:

producing ions from an ion source;

transmitting at least some of said ions through an input vacuum chamber comprising at least one AC ion guide for transmitting said ions, said AC ion guide comprising a plurality of electrodes having apertures, said apertures being aligned so that ions travel through them as they are transmitted by said ion guide;

providing AC potentials to said plurality of electrodes from at least one alternating current (AC) generator connected to an input chamber reference potential;

passing said ions to an analyzer vacuum chamber comprising an ion mass analyzer disposed to receive ions after they have been transmitted by said ion guide;

wherein at least one differential pumping apertured electrode is provided though which ions may pass, said at least one differential pumping apertured electrode being disposed between said input vacuum chamber and said analyzer vacuum chamber to permit said analyzer vacuum chamber to be maintained at a lower pressure than said input vacuum chamber; and wherein at least 90% of said apertures are substantially the same size and at least 90% of said plurality of electrodes forming said AC ion guide are connected to said AC generator in such a way that at any instant during an AC cycle of the output of said AC generator, adjacent ones of said electrodes are supplied respectively with approximately equal positive and negative potentials relative to said input chamber reference potential;

said method further comprising the step of:

maintaining said input vacuum chamber at a pressure selected from the group consisting of: (i) ≧0.1 mbar; (ii) ≧0.5 mbar; (iii) ≧0.7 mbar; (iv) ≧1.0 mbar; (v) ≧1.3 mbar; (vi) ≧1.5 mbar; (vii) ≧2.0 mbar; (viii) ≧2.5 mbar; (ix) ≧3.0 mbar; (x) ≧3.5 mbar; (xi) ≧4.0 mbar; (xii) ≧4.5 mbar; (xiii) ≧5.0 mbar; (xiv) ≧6.0 mbar; (xv) ≧7.0 mbar; (xvi) ≧8.0 mbar; (xvii) ≧9.0 mbar; (xviii) ≧10.0 mbar; (xix) 1–5 mbar; (xx) 1–2 mbar; (xxi) 0.5–1.5 mbar.

27. A method as claimed in claim 26, further comprising maintaining said input vacuum chamber at a pressure selected from the group consisting of: (i) ≦20 mbar; and (ii) ≦30 mbar.

28. A method as claimed in claim 26, further comprising:

providing an intermediate vacuum chamber disposed between said input vacuum chamber and said analyzer vacuum chamber, said intermediate vacuum chamber comprising an AC ion guide for transmitting ions through said intermediate vacuum chamber, said AC ion guide arranged in said intermediate vacuum chamber comprising a plurality of electrodes having apertures, the apertures being aligned so that ions travel through them as they are transmitted by said ion guide;

providing at least one further differential pumping apertured electrode through which ions may pass, disposed between said vacuum chambers to allow said intermediate vacuum chamber to bc maintained at a lower pressure than said input vacuum chamber, and said analyzer vacuum chamber to be maintained at a lower pressure than said intermediate vacuum chamber; and providing an alternating current (AC) generator connected to an intermediate chamber reference potential for providing AC potentials to the AC ion guide in said intermediate vacuum chamber.

29. A method as claimed in claim 28, further comprising maintaining said intermediate vacuum chamber at a pressure selected from the group consisting of: (i) $10^{-3}$–$10^{-2}$ mbar; (ii) ≦$2\times10^{-3}$ mbar; (iii) ≧$5\times10^{-3}$ mbar; (iv) ≦$10^{-2}$ mbar; (v) $10^{-3-5\times10-3}$ mbar; and (vi) $5\times10^{-3}$–$10^{-2}$ mbar.

30. A method as claimed in claim 26, further comprising maintaining the AC ion guide having a length L in the input vacuum chamber at a pressure P, wherein the pressure-length product P×L is selected from the group consisting of: (i) ≧1 mbar cm; (ii) ≧2 mbar cm, (iii) ≧5 mbar cm; (iv) ≧10 mbar cm; (v) ≧15 mbar cm; (vi) ≧20 mbar cm; (vii) ≧25 mbar cm; (viii) ≧30 mbar cm; (ix) ≧40 mbar cm; (x) ≧50 mbar cm; (xi) ≧60 mbar cm; (xii) ≧70 mbar cm; (xiii) ≧80 mbar cm; (xiv) ≧90 mbar cm; (xv) ≧100 mbar cm; (xvi) ≧110 mbar cm; (xvii) ≧120 mbar cm; (xviii) ≧130 mbar cm; (xix)

≧140 mbar cm; (xx) ≧150 mbar cm; (xxi) ≧160 mbar cm: (xxii) ≧170 mbar cm; (xxiii) ≧180 mbar cm; (xxiv) ≧190 mbar cm; and (xxv) ≧200 mbar cm.

31. A mass spectrometer as claimed in claim 1 wherein, if the AC ion guide has a length L and is maintained in the input vacuum at a pressure P, then the pressure-length product P×L is selected from the group consisting of: (i) ≧1 mbar cm; (ii) ≧2 mbar cm; (iii) ≧5 mbar cm; (iv) ≧10 mbar cm; (v) ≧15 mbar cm; (vi) ≧20 mbar cm; (vii) 25 mbar cm; (viii) ≧30 mbar cm; (ix) ≧40 mbar cm; (x) ≧50 mbar cm; (xi) ≧60 mbar cm; (xii) ≧70 mbar cm; (xiii) ≧80 mbar cm; (xiv) ≧90 mbar cm; (xv) ≧100 mbar cm; (xvi) ≧110 mbar cm; (xvii) ≧120 mbar cm; (xviii) ≧130 mbar cm; (xix) ≧140 mbar cm; (xx) ≧150 mbar cm; (xxi) ≧160 mbar cm; (xxii) ≧170 mbar cm; (xxiii) ≧180 mbar cut; (xxiv) ≧190 mbar cm; and (xxv) ≧200 mbar cm.

32. A mass spectrometer comprising:

an ion source for producing ions;

an input vacuum chamber comprising at least one AC ion guide for transmitting said ions, wherein the AC ion guide comprises two interleaved comb arrangements, each said comb arrangement comprising a plurality of electrodes having apertures;

an analyzer vacuum chamber comprising a mass analyzer disposed to receive ions after they have been transmitted by said ion guide; and at least one differential pumping apertured electrode through which ions may pass, said at least one differential pumping apertured electrode being disposed between said input vacuum chamber and said analyzer vacuum chamber to permit said analyzer vacuum chamber to be maintained at a lower pressure than said input vacuum chamber.

33. A mass spectrometer as claimed in claim 32, wherein at least 90% of said apertures are substantially the same size.

34. A mass spectrometer as claimed in claim 32, wherein said plurality of electrodes forming said AC ion guide are connected to an AC generator in such a way that at any instant during an AC cycle of the output of said AC generator, adjacent ones of said electrodes are supplied respectively with approximately equal positive and negative potentials relative to an input chamber reference potential.

35. A mass spectrometer as claimed in claim 32, wherein each comb arrangement comprises a longitudinally extending member having a plurality of electrodes having apertures depending therefrom.

36. A mass spectrometer as claimed in claim 32, wherein said input vacuum chamber has a length and said comb arrangements extend at least x% of said length, x% selected from the group consisting of: (i) ≧50%; (ii) ≧60%; (iii) ≧70%; (iv) ≧80%; (v) ≧90%; and (vi) ≧95%.

37. A mass spectrometer as claimed in claim 32, wherein alternate ones of said electrodes are connected to each other and to one of the output connections of a single AC generator.

38. A mass spectrometer as claimed in claim 32, wherein the AC ion guide comprises at least 4, 5, 6, 7, 8, 9, 10, 20, 30, 40, 50, 60, 70, 80, 90, or 100 electrodes.

39. A mass spectrometer as claimed in claim 32, wherein said electrodes have internal diameters or dimensions selected from the group consisting of: (i) ≦5.0 mm; (ii) ≦4.5 mm; (iii) ≦4.0 mm; (iv) ≦3.5 mm; (v) ≦3.0 mm; (vi) ≦2.5 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

40. A mass spectrometer as claimed in claim 32, wherein the length of said AC ion guide is selected from the group consisting of: (i) ≧100 mm; (ii) ≧120 mm, (iii) ≧150 mm; (iv) 130±10 mm; (v) 100–150 mm; (vi) ≧160 mm; (vii) ≧180 mm; (viii) ≧200 mm; (ix) 130–150 mm; (x) 120–180 mm; (xi) 120–140 mm; (xii) 130 mm ±5, 10, 15, 20, 25 or 30 mm; (xiii) 50–300 mm; (xiv) 150–300 mm; (xv) ≧50 mm; (xvi) 50–100 mm; (xvii) 60–90 mm; (xviii) ≧75 mm (xix) 50–75 mm, (xx) 75–100 mm; (xxi) 150–200 mm; (xxii) >200 mm; and (xxiii) 50–200 mm.

41. A mass spectrometer as claimed in claim 32, further comprising:

an intermediate vacuum chamber disposed between said input vacuum chamber and said analyzer vacuum chamber, said intermediate vacuum chamber comprising an AC ion guide for transmitting ions through said intermediate vacuum chamber, said AC ion guide arranged in said intermediate vacuum chamber comprising a plurality of electrodes having apertures, the apertures being aligned so that ions travel through them as they are transmitted by said ion guide;

at least one further differential pumping apertured electrode through which ions may pass, disposed between said vacuum chambers to allow said intermediate vacuum chamber to be maintained at a lower pressure than said input vacuum chamber, and said analyzer vacuum chamber to be maintained at a lower pressure than said intermediate vacuum chamber, and an alternating current (AC) generator connected to an intermediate chamber reference potential for providing AC potentials to the AC ion guide in said intermediate vacuum chamber.

42. A mass spectrometer as claimed in claim 41, wherein at least 90% of the apertures of the electrodes forming said AC ion guide in said intermediate vacuum chamber are substantially the same size; and at least 90% of said plurality of the electrodes forming said AC ion guide in said intermediate vacuum chamber are connected to the AC generator connected to said intermediate chamber reference potential in such away that at any instant during an AC cycle of the output of the AC generator, adjacent ones of said electrodes forming said AC ion guide arranged in said intermediate vacuum chamber are supplied respectively with approximately equal positive and negative potentials relative to said intermediate chamber reference potential.

43. A mass spectrometer as claimed in claim 41, wherein the AC ion guide in said intermediate vacuum chamber comprises at least 4, 5, 6, 7, 8, 9, 10, 20, 30, 40, 50, 60, 70, 80, 90, or 100 electrodes.

44. A mass spectrometer as claimed in claim 41, wherein said intermediate vacuum chamber is arranged to be maintained at a pressure selected from the group consisting of: (i) $10^{-3}$–$10^{-2}$ mbar, (ii) ≧2×10 mbar; (iii) ≧$5\times10^{-3}$ mbar, (iv) ≦$10^{-2}$ mbar; (v) $10^{-3-5\times10-3}$ mbar and (vi) $5\times10^{-3}$–$10^{-2}$ mbar.

45. A mass spectrometer as claimed in claim 41, wherein electrodes forming said AC ion guide in said intermediate vacuum chamber have internal diameters or dimensions selected from the group consisting or: (i) ≦5.0 mm; (ii) ≦4.5 mm; (iii) ≦4.0 mm; (iv) ≦3.5 mm; (v) ≦3.0 mm; (vi) ≦25 mm; (vii) 3.0±0.5 mm; (viii) ≦10.0 mm; (ix) ≦9.0 mm; (x) ≦8.0 mm; (xi) ≦7.0 mm; (xii) ≦6.0 mm; (xiii) 5.0±0.5 mm; and (xiv) 4–6 mm.

46. A mass spectrometer as claimed in claim 41, wherein the length of said ion guide in said intermediate vacuum chamber is selected from the group consisting of: (i) ≧100 mm; (ii) ≧120 mm (iii) ≧150 mm; (iv) 130±10 mm; (v) 100–150 mm; (vi) ≦160 mm; (vii) ≦180 mm; (viii) ≦200 mm; (ix) 130–150 mm; (x) 120–180 mm; (xi) 120–140 mm; (xii) 130 mm ±5, 10, 15, 20, 25 or 30 mm; (xiii) 50–300 mm;

(xiv) 150–300 mm; (xv) ≧50 mm; (xvi) 50–100 mm; (xvii) 60–90 mm; (xviii) ≧75 mm; (xix) 50–75 mm; (xx) 75–100 mm; (xxi) 150–200 mm; (xxii) ≧200 mm; and (xxiii) 50–200 mm.

47. A mass spectrometer as claimed in claim 32, wherein said ion source atmospheric pressure ion source.

48. A mass spectrometer as claimed in claim 32, wherein said ion source is a continuous ion source.

49. A mass spectrometer as claimed in claim 47, wherein said ion source is an Electrospray ("ES") ion source or an Atmospheric Pressure Chemical Ionisation ("APCI") ion source.

50. A mass spectrometer as claimed in claim 47, wherein said ion source is an Inductively Coupled Plasma ("ICP") ion source.

51. A mass spectrometer as claimed in claim 48, wherein said ion source is an Electrospray ("ES") ion source or an Atmospheric Pressure Chemical Ionisation ("APCI") ion source.

52. A mass spectrometer as claimed in claim 48, wherein said ion source is an inductively Coupled Plasma ("ICP") ion source.

53. A mass spectrometer as claimed in claim 48, wherein said ion source is a Matrix Assisted Laser Desorption Ionisation ("MALDI") ion source.

54. A mass spectrometer as claimed in claim 32, wherein said ion mass analyser is selected from the group consisting of: (i) a Time of Flight mass analyser, (ii) an orthogonal Time of Flight mass analyser, (iii) a quadrupole mass analyser; and (iv) a quadrupole ion trap.

55. Amass spectrometer as claimed in claim 32, wherein said input vacuum chamber is arranged to be maintained at a pressure selected from the group consisting of: (i) ≧0.1 mbar; (ii) ≧0.5 mbar; (iii) ≧0.7 mbar; (iv) ≧1.0 mbar; (v) ≧1.3 mbar, (vi) ≧1.5 mbar; (vii) ≧2.0 mbar; (viii) ≧2.5 mbar; (ix) ≧3.0 mbar; (x) ≧3.5 mbar (xi) ≧4.0 mbar; (xii) ≧4.5 mbar; (xiii) ≧5.0 mbar; (xiv) ≧6.0 mbar; (xv) ≧7.0 mbar; (xvi) ≧8.0 mbar; (xvii) ≧9.0 mbar; (xviii) ≧10.0 mbar; (xix) 1–5 mbar; (xx) 1–2 mbar; and (xxi) 0.5–1.5 mbar.

56. A mass spectrometer as claimed in claim 32, wherein said input vacuum chamber is arranged to be maintained at a pressure selected from the group consisting of: (i) ≦20 mbar; and (ii) ≦30 mbar.

57. A mass spectrometer as claimed in claim 32, wherein if the AC ion guide has a length L and is maintained in the input vacuum chamber at a pressure P, then the pressure-length product p×L is selected from the group consisting of: (i) ≧1 mbar cm; (ii) ≧2 mbar cm; (iii) ≧5 mbar cm; (iv) ≧10 mbar cm; (v) ≧15 mbar cm; (vi) ≧20 mbar cm; (vii) ≧25 mbar cm; (vii) ≧30 mbar cm; (ix) ≧40 mbar cm; (x) ≧50 mbar cm; (xi) ≧60 mbar cm; (xii) ≧70 mbar cm; (xiii) ≧80 mbar cm; (xiv) ≧90 mbar cm; (xv) ≧100 mbar cm; (xvi) ≧110 mbar cm; (xvii) ≧120 mbar cm; (xviii) ≧130 mbar cm; (xix) ≧140 mbar cm; (xx) ≧150 mbar cm; (xxi) ≧160 mbar cm; (xxii) ≧170 mbar cm; (xxiii) ≧180 mbar cm; (xxiv) ≧190 mbar cm; and (xxv) ≧200 mbar cm.

58. A mass spectrometer as claimed in claim 32, wherein the electrodes forming the AC ion guide have a thickness selected from the group consisting of (i) ≦2 mm; (ii) ≦1 mm; (iii) 0.5±0.2 mm; (iv) 0.7±0.1 mm; and (v) 0.5–0.7 mm.

59. A method of mass spectrometry comprising:

producing ions from an ion source;

transmitting at least some of said ions through an input vacuum chamber comprising at least one AC ion guide far transmitting said ions, said AC ion guide comprising two interleaved comb arrangements, each said comb arrangement comprising a plurality of electrodes having apertures;

passing said ions to an analyzer vacuum chamber comprising a mass analyzer disposed to receive ions after they have been transmitted by said ion guide;

wherein at least one differential pumping apertured electrode is provided though which ions may pass, said at least one differential pumping apertured electrode being disposed between said input vacuum chamber and said analyzer vacuum chamber to permit said analyzer vacuum chamber to be maintained at a lower pressure than said input vacuum chamber.

60. A method as claimed in claim 59, wherein each comb arrangement comprises a longitudinally extending member having a plurality of electrodes having apertures depending therefrom.

61. A method as claimed in claim 59 further comprising maintaining said input vacuum chamber at a pressure selected from the group consisting of: (i) ≧0.2 mbar, (ii) ≧0.5 mbar; (iii) ≧0.7 mbar; (iv) ≧1.0 mbar; (v) ≧1.3 mbar, (vi) ≧1.5 mbar; (vii) ≧2.0 mbar, (viii) ≧2.5 mbar; (ix) ≧3.0 mbar; (x) ≧3.5 mbar; (xi) ≧4.0 mbar; (xii) ≧4.5 mbar; (xiii) ≧5.0 mbar; (xiv) ≧6.0 mbar; (xv) ≧7.0 mbar; (xvi) ≧8.0 mbar; (xvii) ≧9.0 mbar; (xviii) ≧10.0 mbar; (xix) 1–5 mbar; (xx) 1–2 mbar; and (xxi) 0.5–1.5 mbar.

62. A method as claimed in claim 59, further comprising maintaining said input vacuum chamber at a pressure selected from the group consisting of: (i) ≧20 mbar; and (ii) ≧30 mbar.

63. A method as claimed in claim 59, further comprising;

providing an intermediate vacuum chamber disposed between said input vacuum chamber and said analyzer vacuum chamber, said intermediate vacuum chamber comprising an AC ion guide for transmitting ions through said intermediate vacuum chamber, said AC ion guide arranged in said intermediate vacuum chamber comprising a plurality of electrodes having apertures, the apertures being aligned so that ions travel through them as they are transmitted by said ion guide;

providing at least one further differential pumping apertured electrode through which ions may pass, disposed between said vacuum chambers to allow said intermediate vacuum chamber to be maintained at a lower pressure than said input vacuum chamber, and said analyzer vacuum chamber to be maintained at a lower pressure than said intermediate vacuum chamber; and providing an alternating current (AC) generator connected to an intermediate chamber reference potential for providing AC potentials to the AC ion guide in said intermediate vacuum chamber.

64. A method as claimed in claim 63, further comprising maintaining said intermediate vacuum chamber at a pressure selected from the group consisting of: (i) $10^{-3}$–$10^{-2}$ mbar; (ii) ≧$2\times10^{-3}$ mbar; (iii) ≧$5\times10^{-3}$ mbar; (iv) ≦$10^{-2}$ mbar; (v) $10^{-3}$–$5\times10^{-3}$ mbar; and (vi) $5\times10^{-3}$–$10^{-2}$ mbar.

65. A method as claimed in claim 59, further comprising maintaining the AC ion guide having a length L in the input vacuum chamber at a pressure P, wherein the pressure-length product p×L is selected from the group consisting of: (i) ≧1 mbar cm; (ii) ≧2 mbar cm; (iii) ≧5 mbar cm; (iv) ≧10 mbar cm; (v) ≧15 mbar cm; (vi) ≧20 mbar cm; (vii) ≧25 mbar cm; (viii) ≧30 mbar cm; (ix) ≧40 mbar cm; (x) ≧50 mbar cm; (xi) ≧60 mbar cm; (xii) ≧70 mbar cm; (Xiii) ≧80 mbar cm; (xiv) ≧90 mbar cm; (xv) ≧100 mbar cm; (xvi) ≧110 mbar cm; (xvii) ≧120 mbar cm; (xviii) ≧130 mbar cm; (xix) ≧140 mbar cm; (xx) ≧150 mbar cm; (xxi) ≧160 mbar cm; (xxii) ≧170 mbar cm; (xxiii) ≧180 mbar cm; (xxiv) ≧190 mbar cm; and (xxv) ≧200 mbar cm.

* * * * *